US010029392B2

(12) United States Patent
Kanbayashi

(10) Patent No.: US 10,029,392 B2
(45) Date of Patent: Jul. 24, 2018

(54) METHOD FOR SLICING WORKPIECE

(71) Applicant: SHIN-ETSU HANDOTAI CO., LTD., Tokyo (JP)

(72) Inventor: Keiichi Kanbayashi, Nishigo-mura (JP)

(73) Assignee: SHIN-ETSU HANDOTAI CO., LTD., Tokyo (JP)

( * ) Notice: Subject to any disclaimer, the term of this patent is extended or adjusted under 35 U.S.C. 154(b) by 33 days.

(21) Appl. No.: 15/027,157

(22) PCT Filed: Oct. 27, 2014

(86) PCT No.: PCT/JP2014/005413

§ 371 (c)(1),
(2) Date: Apr. 4, 2016

(87) PCT Pub. No.: WO2015/075869

PCT Pub. Date: May 28, 2015

(65) Prior Publication Data

US 2016/0250776 A1 Sep. 1, 2016

(30) Foreign Application Priority Data

Nov. 21, 2013 (JP) ..... 2013-240679

(51) Int. Cl.
*B28D 5/04* (2006.01)
*B24B 27/06* (2006.01)
*B28D 7/02* (2006.01)

(52) U.S. Cl.
CPC ..... *B28D 5/045* (2013.01); *B24B 27/0633* (2013.01); *B28D 7/02* (2013.01)

(58) Field of Classification Search
CPC ..... B28D 5/045; B28D 7/02; B24B 27/0633; B26D 2001/008; B26D 1/547; B26D 1/553; B26D 5/00; H01L 21/304
See application file for complete search history.

(56) References Cited

U.S. PATENT DOCUMENTS 5,829,424 A 11/1998 Hauser
6,328,027 B1 12/2001 Persyk et al.
(Continued)

FOREIGN PATENT DOCUMENTS

CN 2597171 Y 1/2004
CN 101855045 A 10/2010
(Continued)

OTHER PUBLICATIONS

Nov. 30, 2016 Chinese Search Report issued in Chinese Patent Application No. 201480056205X.
Jan. 20, 2015 Search Report issued in International Patent Application No. PCT/JP2014/005413.
(Continued)

*Primary Examiner* — Christopher M Koehler
*Assistant Examiner* — Joel Crandall
(74) *Attorney, Agent, or Firm* — Oliff PLC

(57) ABSTRACT

A method for slicing workpiece reusing a wire used for previous slicing of a workpiece to slice a subsequent workpiece by which the workpiece is pressed against a wire row and sliced, the wire row being formed of the wire spirally wound between a plurality of wire guides and travels in an axial-direction, where wire tension at the time of slicing the workpiece is set to a value in the range of 87 to 95% of wire tension in the previous slicing of the workpiece, a new wire supply amount at the time of slicing the workpiece is set to a value in the range of 125% or more of a new wire supply amount in the previous slicing of the workpiece, and the wire is reused to slice the subsequent workpiece.

2 Claims, 6 Drawing Sheets

(56) References Cited

U.S. PATENT DOCUMENTS

| | | | | |
|---|---|---|---|---|
| 2004/0255924 | A1* | 12/2004 | Kondo | B23D 57/0053 125/41 |
| 2010/0163009 | A1* | 7/2010 | Kawasaki | B23D 57/0023 125/16.01 |
| 2010/0180880 | A1* | 7/2010 | Oishi | B23D 57/0046 125/16.02 |
| 2012/0298091 | A1* | 11/2012 | Hoshiyama | B23D 57/0069 125/16.02 |

FOREIGN PATENT DOCUMENTS

| | | | |
|---|---|---|---|
| CN | 102179880 | A | 9/2011 |
| CN | 102528954 | A | 7/2012 |
| JP | H09-109013 | A | 4/1997 |
| JP | H10-86140 | A | 4/1998 |
| JP | 2000-042896 | A | 2/2000 |
| TW | 201127578 | A | 8/2011 |

OTHER PUBLICATIONS

Oct. 28, 2016 Search Report issued in Taiwanese Patent Application No. 103138920.

* cited by examiner

CONVENTIONAL

CONVENTIONAL

CONVENTIONAL

METHOD FOR SLICING WORKPIECE

TECHNICAL FIELD

The present invention relates to a method for slicing workpiece using a wire saw.

BACKGROUND ART

In recent years, enlargement of semiconductor wafers has been demanded, and a wire saw is exclusively used for slicing workpieces.

The wire saw is a device that enables a wire (a high tensile steel wire) to travel at high speed, and presses a workpiece (e.g., a silicon ingot) against the wire to be sliced while applying slurry to the wire so that many wafers are simultaneously sliced out (see Patent Document 1).

Here, FIG. 6 is a schematic view showing of an example of a conventional general wire saw.

As shown in FIG. 6, a wire saw 101 is mainly constituted of a wire 102 configured to slice a workpiece, a wire guide 103 around which the wire 102 is wound, a tension giving mechanism 104 configured to give tension to the wire 102, workpiece feeding means 105 configured to feed the workpiece to be sliced, a nozzle 106 configured to supply slurry obtained by dispersing and mixing abrasive grains such as SiC fine powder in a coolant at the time of slicing, and others.

The wire 102 is reeled out from one wire reel bobbin 107, passes through the tension giving mechanism 104 formed of, e.g., a powder clutch (a constant torque motor 109) or a dancer roller (a deadweight) (not shown), and enters the wire guide 103 through a traverser 108. The wire 102 is wound around this wire guide 103 for approximately 300 to 400 turns, and then taken up by the other wire reel bobbin 107' through the other tension giving mechanism 104'.

Further, the wire guide 103 is a roller provided by press-fitting a polyurethane resin into the periphery of a steel cylinder and forming grooves on a surface thereof at a fixed pitch, and the wound wire 102 can be driven in reciprocating directions at a preset cycle by a driving motor 110.

Furthermore, a nozzle 106 is provided near the wire guide 103 and the wound wire 102 so that the slurry can be supplied to the wire guide 103 and the wire 102 from this nozzle 106 at the time of slicing. Moreover, after the slicing, the slurry is discharged as waste slurry.

Such a wire saw 101 is used, appropriate wire tension is applied to the wire 102 by the tension giving mechanism 104, the wire 102 is allowed to travel in the reciprocating directions by the driving motor 110, and the workpiece is sliced while supplying the slurry, thereby providing a desired sliced wafer.

Additionally, as to the wire 102 used in the wire saw, a length of the wire 102 supplied to slice one workpiece is called a new wire supply amount.

The wire 102 corresponding to a length of several hundred km is wound around the wire reel bobbin 107, and a plurality of workpieces are sliced by using the wire 102 wound around this wire reel bobbin 107.

In case of reducing costs required for the wire included in wafer manufacturing costs, there is a method for increasing the number of workpieces that can be sliced per wire reel bobbin by reducing a necessary new wire supply amount per workpiece.

For example, it is assumed that the new wire supply amount used for slicing one workpiece with the wire reel bobbin having 510 km of the wire wound thereon is 170 km, and three workpieces are sliced. When the new wire supply amount used in each slicing process is reduced to half, i.e., 85 km, the number of the workpieces that can be sliced with the use of the same length of the wire, i.e., one wire reel bobbin can be increased to six.

When the new wire supply amount used for slicing each workpiece is reduced in this manner, since an amount of the wire used for slicing each workpiece is lowered, the number of the workpieces that can be sliced with the use of one wire reel bobbin can be increased, and costs required for the wire can be decreased.

CITATION LIST

Patent Literature

Patent Document 1: Japanese Unexamined Patent Publication (Kokai) No. H 10-86140

SUMMARY OF INVENTION

Technical Problems

However, as a problem of the method, there arises a problem that, since the new wire supply amount is reduced, an amount of abrasion of the wire itself at the time of slicing the workpieces increases as compared with an amount before reducing the new wire supply amount, and a diameter of the wire becomes small. When the diameter of the wire becomes small, wafer quality after slicing is degraded.

As typical wafer quality, there is a warp of a wafer. It is desirable for a wafer after slicing to have a smaller warp. However, when the diameter of the wire is small, a carrying-in amount of the slully applied to the wire is reduced, slicing efficiency is lowered, and hence the warp of the wafer after slicing increases.

Further, when the diameter of the wire becomes small, breaking strength of the wire is decreased, and hence the wire is apt to break during slicing of a workpiece.

When the wire breaks during slicing of the workpiece, slicing is interrupted, and a recovery operation requires plenty of labor and time, thereby considerably lowering wafer production efficiency. Furthermore, when the breakage of the wire occurs, wafer quality of after slicing is greatly degraded. Thus, it is desirable to suppress occurrence of the breakage of the wire as much as possible.

As means which can be a substitute for the method for reducing the new wire supply amount used for slicing per workpiece as described above, there is a method for reusing a used wire. When the used wire once used for slicing a workpiece is reused under the same conditions, the number of workpieces that can be sliced with the use of one wire reel bobbin can be increased.

However, when the wire is reused according to this method, the wire breakage of the used wire is apt to occur at the time of slicing the workpiece. Moreover, a warp of the sliced wafer becomes large.

In view of the problem, it is an object of the present invention to provide a workpiece slicing method that can reduce occurrence of breakage of a wire while increasing the number of workpieces that can be sliced by the same wire, and suppress degradation of a warp of a wafer by slicing the workpieces under conditions different from previous conditions for slicing the workpieces with the reuse of the used wire that is used for previous slicing of the workpieces.

Solution to Problem

To achieve this object, the present invention provides a workpiece slicing method for reusing a wire used for previous slicing of a workpiece to slice a subsequent workpiece in the slicing of the workpiece by which the workpiece is pressed against a wire row and the workpiece is sliced, the wire row being formed of the wire that is spirally wound between a plurality of wire guides and travels in an axial direction, wherein wire tension at the time of slicing the subsequent workpiece is set to a value in the range of 87 to 95% of wire tension in the previous slicing of the workpiece, a new wire supply amount at the time of slicing the subsequent workpiece is set to a value in the range of 125% or more of a new wire supply amount in the previous slicing of the workpiece, and the wire is reused to slice the subsequent workpiece.

Even if the used wire is reused for slicing workpieces, when slicing of a subsequent workpiece is carried out while controlling wire tension and a new wire supply amount to values in the above ranges of wire tension and a new line supply amount in the previous use, breakage of the wire is hard to occur, degradation of a warp of the wafer can be suppressed, and wafer quality can be maintained at the same level as that in the previous slicing.

At this time, it is preferable to set a workpiece feed rate to a value in the range of 83 to 91% of a workpiece feed rate in the previous slicing of the workpiece in case of slicing the subsequent workpiece.

With the configuration, even if the workpieces are sliced with the reuse of the used wire, degradation of the warp of the wafer after slicing can be further assuredly suppressed.

Advantageous Effects of the Invention

According to the workpiece slicing method of the present invention, reusing the used wire enables greatly increasing the number of workpieces that can be sliced by the same wire, and hence costs required for the wire can be largely reduced. Additionally, at the time of reusing the wire, when slicing is performed while controlling the wire tension and the new line supply amount to appropriate ranges like the present invention, an incidence of the breakage of the wire and degradation of quality of the wafer can be suppressed, and the wafer with the same quality as that provided by the previous slicing can be obtained.

DESCRIPTION OF EMBODIMENTS

Although an embodiment according to the present invention will now be described hereinafter, the present invention is not restricted thereto.

As described above, in case of reusing a wire that has been once used for slicing workpieces, since a diameter of the wire is reduced, there occurs a problem that the wire breaks or wafer quality is degraded.

Thus, the present inventor has pursued intensive studies to solve such a problem. Consequently, the present inventor conceived that, in case of reusing a wire that has been once used for slicing workpieces, breakage of the wire or degradation of wafer quality can be suppressed by setting wire tension and a new wire supply amount to a value in the range of 87 to 95% and a value in the range of 125% or more of wire tension and a new wire supply amount in previous workpiece slicing respectively, and thereby bringing the present invention to completion.

A workpiece slicing method according to the present invention will now be described hereinafter with reference to FIGS. 1 to 3. A description will be given as to a case where a wire used which has been once used for slicing workpieces is reused and the workpiece slicing method according to the present invention is applied at the time of performing second slicing of workpieces.

A wire saw 1 adopted in the workpiece slicing method according to the present invention will be first described with reference to FIG. 2.

Figure 2:
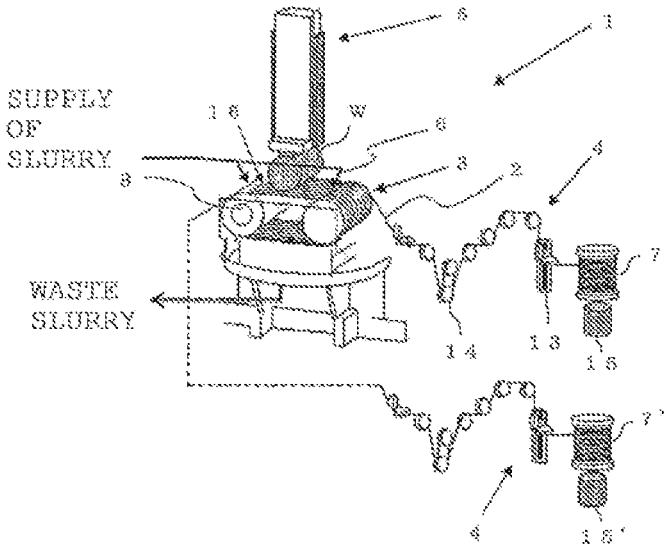
FIG. 2 is a schematic view showing an example of a wire saw for use in the workpiece slicing method according to the present invention.

As shown in FIG. 2, the wire saw 1 is mainly constituted of a wire 2 configured to slice a workpiece W, wire guides 3, wire tension giving mechanisms 4 and 4' configured to give tension to the wire 2, work feeding means 5 that relatively depresses the workpiece W while holding it, a nozzle 6 configured to supply a working fluid to the wire 2 at the time of slicing, and others.

The wire 2 is reeled out from one wire reel bobbin 7, passes through the tension giving mechanism 4 formed of, e.g., a powder clutch (a constant torque motor 14) or a dancer roller (a deadweight) (not shown), and enters the wire guide 3 through a traverser 13. A wire row 16 is formed by winding the wire 2 around the plurality of wire guides 3 for approximately 300 to 400 turns. The wire 2 is taken up by a wire reel bobbin 7' via the other wire tension giving mechanism 4'. As this wire, for example, a high tensile steel wire can be used. The wire reel bobbins 7 and 7' are driven to rotate by wire reel bobbin drive motors 15 and 15', respectively. Furthermore, wire tension applied to the wire 2 is precisely adjusted by the tension giving mechanism 4 and 4'.

The nozzle 6 supplies a working fluid to a contact portion of the workpiece W and the wire 2. Although this nozzle 6 is not restricted in particular, it can be arranged above the wire 2 wound around the wire guide 3. The nozzle 6 may be connected to a slurry tank (not shown), and slurry to be supplied may be supplied to the wire 2 from the nozzle 6 while controlling its supply temperature by a slurry chiller (not shown).

Here, a type of the working fluid used during slicing of the workpiece W is not restricted in particular, the same type as that in conventional examples can be used, and the working fluid may have, e.g., silicon carbide abrasive grains or diamond abrasive grains dispersed in a coolant. As the coolant, for example, a water-soluble or oil-based coolant can be used.

Figure 3:
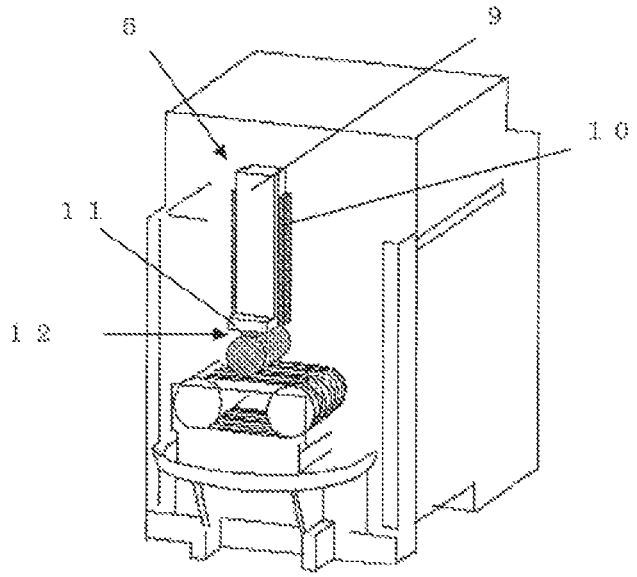
FIG. 3 is a schematic view showing an example of workpiece feeding means in the wire saw for use in the workpiece slicing method according to the present invention.

At the time of slicing the workpiece W, the workpiece W is fed to the wire 2 wound around the wire guides 3 by such workpiece feeding means 5 as shown in FIG. 3. This workpiece feeding means 5 is constituted of a workpiece feed table 9 configured to feed a workpiece, an LM (Linear Motion) guide 10, a workpiece clamp 11 that holds a workpiece, a slice back plate 12, and others, and the workpiece W fixed at a tip can be fed at a preprogrammed feed rate by driving the workpiece feed table 9 along the LM guide 10 under computer control.

The wire guide 3 is a roller provided by press-fitting a polyurethane resin into the periphery of a steel cylinder and forming grooves on a surface thereof at a fixed pitch, and is configured to prevent damage to the wire 2 and suppress wire disconnection and the like. Moreover, the wire guide 3 enables the wound wire 2 to reciprocably travel in an axial direction by using a drive motor 8. At the time of enabling the wire 2 to reciprocably travel, traveling distances of the wire 2 in both directions are not set to be equal, but the traveling distance in one direction is set to be longer. When the wire 2 is enabled to reciprocably travel in this manner, a new wire of the wire 2 is supplied in the direction with the longer traveling distance. Additionally, a new wire supply amount which is a length of the wire 2 supplied to slice one workpiece can be adjusted by the drive motor 8.

A method for slicing the workpiece W according to the present invention when this wire saw 1 is used will now be described.

First, in the wire saw 1, the plurality of workpieces W are sequentially pressed against the wire row 16 and slice while allowing the wire 2 to reciprocably travel as described above. When slicing a predetermined number of workpieces is finished, the wire 2 is stopped. In this manner, first slicing of the workpieces is performed (S101 in FIG. 1).

This first slicing of the workpieces can be performed based on the same slicing method as that in the conventional examples. In the first slicing, since the wire used for the slicing is not abraded, its diameter is sufficiently large, an incidence ratio of breakage of the wire is lower, and a wafer with excellent wafer quality after the slicing can be provided.

After the first slicing is finished as described above, the wire 2 taken up by the wire reel bobbin 7' at the time of the first slicing is wound back around the wire reel bobbin 7, and the preparation to use the once used wire 2 for slicing a subsequent workpiece W is promoted. At this time, this used wire 2 can be reused for subsequent second slicing of the workpieces as it is without performing a treatment such as cleaning.

Then, the workpiece W is held by the workpiece feeding means 5. Further, the wire 2 is allowed to reciprocably travel in the axial direction by the drive motor 8 while giving tension to the wire 2 by the wire tension giving mechanisms 4 and 4'.

At this time, in the present invention, the wire tension is set to a value in the range of 87 to 95% of wire tension in the previous slicing of workpieces (in this case, the first slicing).

Since the diameter of the wire is smaller than that in the previous slicing of the workpieces due to abrasion, breaking strength of the wire is lowered. Thus, in case of reusing the wire, the wire tension is set to a value which is 95% or less of that in the previous slicing of the workpieces. Furthermore, when the wire tension is set to 87% or more without being extremely reduced, wafer quality after the slicing is hard to degrade.

Figure 4:
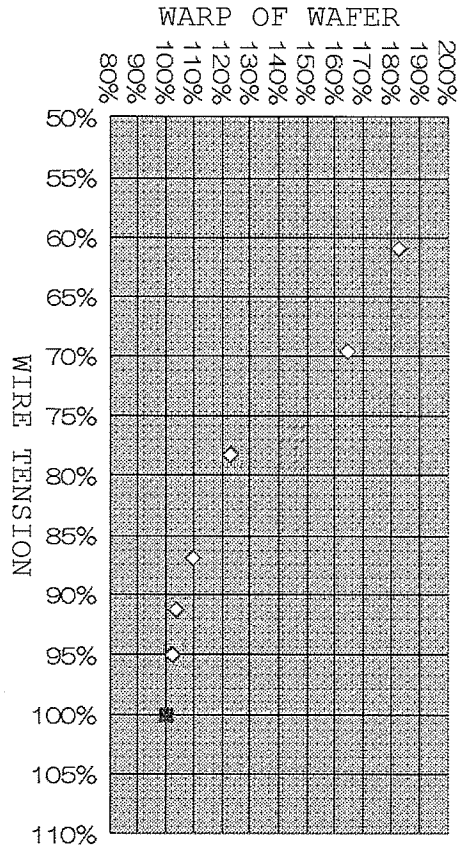
FIG. 4 is a view showing a relationship between a warp of a wafer and wire tension when the wire is reused.

Here, FIG. 4 shows an influence on the wafer quality when the wire tension at the time of reusing the wire 2 is set to be smaller than normally set wire tension (the same wire tension as that in the previous slicing of the workpieces). In a graph of FIG. 4, an axis of abscissa represents the wire tension, and an axis of ordinate represents a warp of a wafer. The normally set wire tension and the warp of the wafer after slicing in this case are determined as 100% respectively, and the wire tension and the warp of the wafer are represented by using relative values. As can be seen from FIG. 4, when the wire tension was set to be too small, the warp of the wafer tended to increase.

Furthermore, as shown in FIG. 4, when the wire tension was 87%, the warp of the wafer after the slicing was 110% which was a 10% increase from that at the time of slicing the workpiece in the normal setting. Since a further increase cannot be allowed, a lower limit value of the wire tension was set to 87%. Moreover, when the wire tension was set to 96% or more and the slicing was performed, wire breakage frequently occurred, and hence an upper limit value of the wire tension was set to 95%.

Additionally, in the present invention, the new wire supply amount which is a length of the wire 2 supplied to slice one workpiece is set to a value in the range of 125% or more of a new wire supply amount in the previous slicing of the workpiece (in this case, in the first slicing).

The new wire supply amount at the time of slicing the workpiece W relates to a wire abrasion loss. The wire abrasion loss is a difference between a diameter of the wire 2 before being used for slicing the workpiece W and a diameter of the workpiece 2 after being used for slicing the workpiece W. Although the wire 2 is abraded and thinned in a process of slicing the workpiece W, the wire abrasion loss is decreased as the new wire supply amount is increased and, on the other hand, the wire abrasion loss is increased as the new wire supply amount is decreased. In the present invention, the wire abrasion loss can be adjusted to 80% or less of the wire abrasion loss in the previous slicing by increasing the new wire supply amount to a value in the range of 125% or more of the new wire supply amount in the previous slicing of the workpiece.

Figure 5:
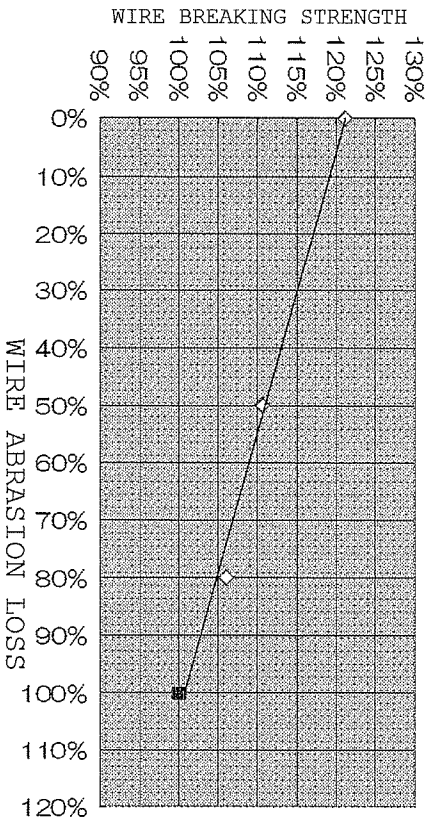
FIG. 5 is a view showing a relationship between wire breaking strength and a new wire supply amount when the wire is reused.
Figure 6:
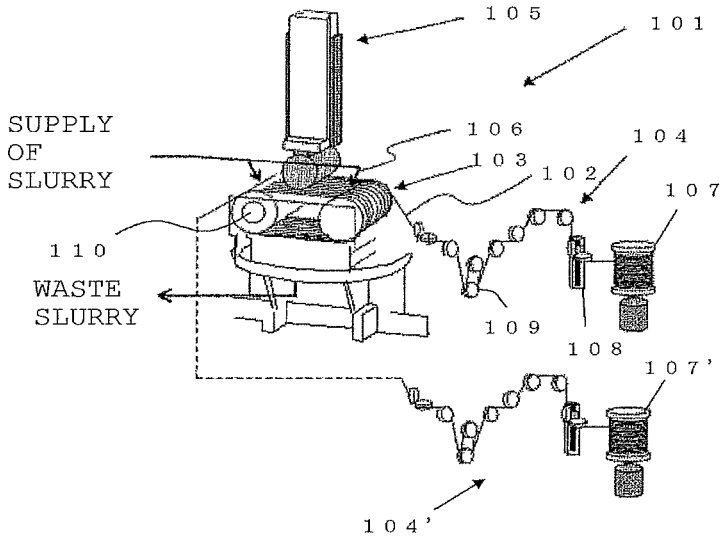
FIG. 6 is a schematic view showing an example of a general wire saw.

Here, FIG. 5 shows an influence on the wire abrasion loss and the breaking strength of the wire when the new wire supply amount at the time of reusing the wire is increased to be higher than a normally set new wire supply amount (the same new wire supply amount as that in the previous slicing of the workpiece). FIG. 5 shows a relationship between the breaking strength of the wire and the wire abrasion loss. In a graph of FIG. 5, an axis of abscissa represents the wire abrasion loss, and an axis of ordinate represents the breaking strength of the wire. The wire abrasion loss and the breaking strength of the wire are represented as relative values when the wire abrasion loss and the breaking strength in the normal setting (the same new wire supply amount as that in the previous slicing) are determined as 100% respectively.

As shown in FIG. 5, when the wire abrasion loss is set to 80% or less by setting the new wire supply amount to a value in the range of 125% or more of the new wire supply amount in the previous slicing of the workpiece, a thick diameter of the wire can be thereby maintained, and the breaking strength of the wire can be increased to be approximately 5% higher than breaking strength in a case where the new wire supply amount is the same as that in the previous slicing. This corresponds to decreasing the wire tension by approximately 10%, and the wire breakage hardly occurs.

As described above, occurrence of the breakage of the wire can be suppressed by increasing the new wire supply amount even though the used wire 2 is reused, and the slicing can be carried out without greatly degrading the wafer quality such as a warp of the wafer. It is to be noted that, when the new wire supply amount is extremely raised, since consumption of the wire required to slice each workpiece increases, preventing the new wire supply amount from being extremely raised is desirable, and the new wire supply amount is set to e.g., 200% or less.

Subsequently, the workpiece W is relatively depressed by the workpiece feeding means 5, the workpiece W is pressed against the wire row 16, and the slicing of the first workpiece W in reuse is started. At the time of slicing the workpiece W, the slicing is advanced while supplying the working fluid from the nozzle 6 to a contact portion of the workpiece W and the wire 2.

At this time, it is preferable to set a feed rate of the workpiece to a value in the range of 83 to 91% to a feed rate of the workpiece in the previous slicing of the workpieces (in this case, the first slicing).

When the feed rate of the workpiece is lowered to 91% or less of the feed rate of the workpiece in the previous slicing of the workpieces in this manner, it is possible to cover a reduction in slicing efficiency due to a decrease in carrying-in amount of the slurry caused by a thin diameter of the wire. Furthermore, when the feed rate of the workpiece is set to 83% or more of the feed rate of the workpiece in the previous slicing of the workpieces, degradation of production efficiency of wafers can be suppressed without extremely slowing down a slicing rate of the workpiece.

As described above, the workpiece W is downwardly depressed while controlling the wire tension and the new wire supply amount, the slicing is advanced, the slicing is completed, then a feed direction of the workpiece W is reversed to take out the sliced workpieces W from the wire row 16, and sliced wafers are collected. As described above, the plurality of workpieces are sequentially and repeatedly sliced into wafer forms by using the once used wire 2. In this manner, the second slicing is performed with the use of the once used wire 2 (S102 in FIG. 1).

According to such a workpiece slicing method, the number of workpieces that can be sliced by the same wire can be greatly increased by reusing the once used wire, and costs required for the wire can be considerably reduced. Moreover, at the time of reusing the wire, when the wire tension and the new wire supply amount are controlled to appropriate ranges and then the slicing is performed like the present invention, an incidence ratio of the breakage of the wire and degradation of the wafer quality after the slicing can be suppressed, and wafers of the same quality as that in the previous slicing can be provided.

Figure 1:
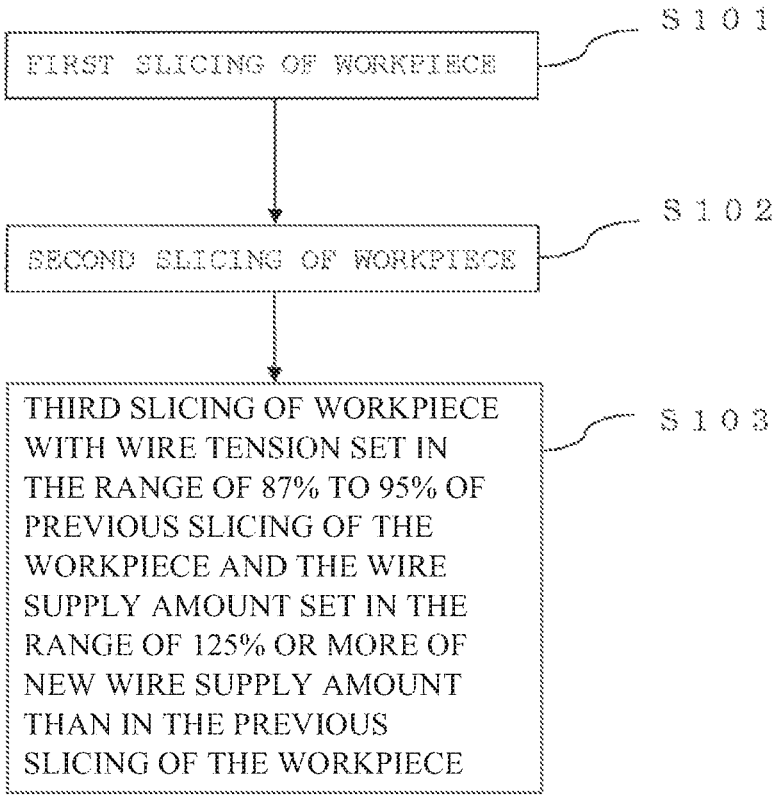
FIG. 1 is a flowchart showing an example of a workpiece slicing method according to the present invention.

Additionally, after the second slicing, at the time of third slicing, the wire tension can be set a value in the range of 87% to 95% of the wire tension in the previous slicing of the workpieces (in this case, the second slicing), the new wire supply amount can be set to a value in the range of 125% or more of the new wire supply amount in the previous slicing of the workpieces (in this case, the second slicing), and the slicing of the workpieces can be repeatedly carried out (S103 in FIG. 1). Further, until the diameter of the wire is reduced and the wire reaches its end of life, the workpiece slicing method according to the present invention can be used in fourth or fifth and subsequent slicing processes so that workpieces can be sliced by using the same wire.

EXAMPLES

Although the present invention will now be more specifically described hereinafter in conjunction with examples of the present invention and comparative examples, the present invention is not restricted thereto.

Example 1

Such a wire saw as shown in FIG. 2 or 3 was used, and a wire once used for slicing workpieces was reused to carry out second slicing of workpieces.

A single-crystal silicon ingot was used as a workpiece, and a high-carbon steel brass-plated steel wire was used as a wire. The single crystal silicon ingot having a diameter of 300 mm and a length of 100 to 450 mm was sliced with the use of the wire having a diameter of 0.13 mm, and then the second slicing of the workpieces was performed by the used wire. Four silicon ingots were sliced per wire reel bobbin when the wire was used for the first time, and four silicon ingots were sliced with the same wire reel bobbin when the wire was used for the second time.

As shown by Conditions 2 in Table 1, wire tension, a new wire supply mount, and a workpiece feed rate were set to 91%, and 125%, and 100% of wire tension, a new wire supply amount, and a workpiece feed rate in the first use of the wire as conditions for the second use of the wire respectively, where the workpiece feed rate was not changed, and the slicing was performed. As a wire breakage incidence ratio and a warp of wafers in Table 1, relative values provided when values in the first use of the wire are determined as 1 are shown. As the wire breakage incidence ratio and the warp of wafers are lowered, these relative values are reduced. Smaller values are desirable for the wire breakage incidence ratio and the warp of wafers.

Consequently, the wire breakage incidence ratio was 1.6 times a counterpart in the first use of the wire, which is a problem-free level. Further, the warp of wafers was 1.07 times a counterpart in the first use, which is a problem-free level.

As described above, according to the workpiece slicing method of the present invention, it was confirmed that, even if the used wire is reused, the wire breakage incidence ratio and the warp of wafers can be reduced to the problem-free levels, the wafers of the almost same quality as that in the previous slicing can be provided while decreasing costs required for the wire.

Example 2

Like Example 1, a wire once used for slicing workpieces was reused to slice workpieces for the second time.

As shown by Conditions 3 in Table 1, wire tension, a new wire supply amount, and a workpiece feed rate were set to 91%, 125%, and 90% of wire tension, a new wire supply amount, and a workpiece feed rate in the first use of the wire respectively as conditions for the second use of the wire, and the slicing was performs. Consequently, a wire breakage incidence ratio was 1.6 times and substantially equal to a counterpart in the first use of the wire, which was a problem-free level. Furthermore, a warp of wafers was 0.99 times a warp of wafers in the first use, and wafer quality was improved beyond Example 1.

As described above, in the workpiece slicing method according to the present invention, it was confirmed that controlling the workpiece feed rate to 83 to 91% enables further improving the warp of wafers.

Example 3

Like Example 1, a wire once used for slicing workpieces was reused to slice workpieces for the second time.

As shown by Conditions 4 in Table 1, wire tension, a new wire supply mount, and a workpiece feed rate were set to 87%, 125%, and 100% of wire tension, a new wire supply amount, and a workpiece feed rate in the first use of the wire as conditions for the second use of the wire respectively, where the workpiece feed rate was not changed, and the slicing was performed.

Consequently, a wire breakage incidence ratio was 1.4 times a counterpart in the first use of the wire, which was a problem-free level. Moreover, a warp of wafers was 1.07 times a warp of wafers in the first use, which was a problem-free level.

Example 4

Like Example 1, a wire once used for slicing workpieces was reused to slice workpieces for the second time.

As shown by Conditions 5 in Table 1, wire tension, a new wire supply mount, and a workpiece feed rate were set to 95%, 125%, and 100% of wire tension, a new wire supply amount, and a workpiece feed rate in the first use of the wire as conditions for the second use of the wire respectively, where the workpiece feed rate was not changed, and the slicing was performed.

Consequently, a wire breakage incidence ratio was 1.7 times a counterpart in the first use of the wire, which was a problem-free level. Moreover, a warp of wafers was 1.02 times a warp of wafers in the first use, which was a problem-free level.

Comparative Example 1

Like Example 1, a wire once used for slicing workpieces was reused to slice workpieces for the second time.

As shown by Conditions 1' in Table 1, the same wire tension (a value of 100% of a counterpart in the first use of the wire), the same new wire supply mount (a value of 100% of a counterpart in the first use of the wire), and the same workpiece feed rate (a value of 100% of a counterpart in the first use of the wire) as those at the time of slicing workpieces in the first use of the wire were set, and the slicing was performed. Consequently, a warp of wafers was the same as a counterpart in the first use of the wire, but a wire breakage incidence ratio was greatly degraded to 12.6 times a counterpart in the first use of the wire.

It was confirmed that, when the wire was reused for the slicing of the workpieces under such conditions as those in Comparative Example 1, since the wire breakage incidence ratio is too high, high-quality wafers cannot be stably provided, and the wire cannot be actually reused.

Comparative Example 2

Like Example 1, a wire once used for slicing workpieces was reused to slice workpieces for the second time.

As shown by Conditions 6 in Table 1, wire tension, a new wire supply amount, and a workpiece feed rate were set to 86%, 125%, and 100% of wire tension, a new wire supply amount, and a workpiece feed rate in the first use of wire as conditions for second use of the wire as conditions for the second use of the wire respectively, where the workpiece feed rate was not changed, and the slicing was performed. Consequently, a wire breakage incidence ratio was 1.4 times a counterpart in the first use of the wire. Further, a warp of wafers was 1.2 times a counterpart in the first use of the wire.

It was confirmed that, when the wire was reused for the slicing of the workpieces under such conditions as those in Comparative Example 2, wafers of the almost same quality as that in the previous slicing cannot be stably provided like Examples 1 to 4, and the wire cannot be actually reused.

Comparative Example 3

Like Example 1, a wire once used for slicing workpieces was reused to slice workpieces for the second time.

As shown by Conditions 7 in Table 1, wire tension, a new wire supply amount, and a workpiece feed rate were set to 96%, 125%, and 100% of wire tension, a new wire supply amount, and a workpiece feed rate in the first use of wire as conditions for the second use of the wire respectively, where the workpiece feed rate was not changed, and the slicing was performed. Consequently, a wire breakage incidence ratio was 3.6 times a counterpart in the first use of the wire. Further, a warp of wafers was 1.02 times a counterpart in the first use of the wire.

When the wire was reused for the slicing of the workpieces under such conditions as those in Comparative Example 3, since the wire tension was set to 96%, wire breakage frequently occurred. It was confirmed that, since the wire breakage incidence ratio was too high, high-quality wafers cannot be stably provided like Examples 1 to 4, and the wire cannot be actually reused.

Comparative Example 4

Like Example 1, a wire once used for slicing workpieces was reused to slice workpieces for the second time.

As shown by Conditions 8 in Table 1, wire tension, a new wire supply amount, and a workpiece feed rate were set to 91%, 124%, and 100% of wire tension, a new wire supply amount, and a workpiece feed rate in the first use of wire as conditions for the second use of the wire respectively, where the workpiece feed rate was not changed, and the slicing was performed. Consequently, a wire breakage incidence ratio was 4.0 times a counterpart in the first use of the wire. Further, a warp of wafers was 1.07 times a counterpart in the first use of the wire.

It was confirmed that, when the wire was reused for the slicing of the workpieces under such conditions as those in Comparative Example 4, wafers of the same quality as that in the previous slicing cannot be stably provided like Examples 1 to 4, and the wire cannot be actually reused.

Table 1 shows an outline of implementation results in Examples 1 to 4 and Comparative Examples 1 to 4.

TABLE 1

| | | Example 1 | Example 2 | Example 3 | Example 4 | Comparative Example 1 | Comparative Example 2 | Comparative Example 3 | Comparative Example 4 |
|---|---|---|---|---|---|---|---|---|---|
| Number of times of using wire | First | Second | Second | Second | Second | Second | Second | Second | Second |
| Conditions | Conditions 1 | Conditions 2 | Conditions 3 | Conditions 4 | Conditions 5 | Conditions 1' | Conditions 6 | Conditions 7 | Conditions 8 |
| Wire tension | 100% | 91% | 91% | 87% | 95% | 100% | 86% | 96% | 91% |
| New wire supply amount | 100% | 125% | 125% | 125% | 125% | 100% | 125% | 125% | 124% |

TABLE 1-continued

| | | Example 1 | Example 2 | Example 3 | Example 4 | Comparative Example 1 | Comparative Example 2 | Comparative Example 3 | Comparative Example 4 |
|---|---|---|---|---|---|---|---|---|---|
| Workpiece feed rate | 100% | 100% | 90% | 100% | 100% | 100% | 100% | 100% | 100% |
| Wire breakage incidence ratio | 1 | 1.6 | 1.6 | 1.4 | 1.7 | 12.6 | 1.4 | 3.6 | 4.0 |
| Warp of wafers | 1 | 1.07 | 0.99 | 1.07 | 1.02 | 1 | 1.20 | 1.02 | 1.07 |

The wire tension, the new wire supply amount, and the workpiece feed rate . . . *values in the first use of the wire are determined as 100%, respectively.

The wire breakage incidence ratio and the warp of wafers . . . *values in the first use of the wire are determined as 1, respectively.

It is to be noted that the present invention is not restricted to the foregoing embodiments. The foregoing embodiments are illustrative examples, and any example that has substantially the same configuration and exerts the same functions and effects as the technical concept described in claims of the present invention are included in the technical scope of the present invention.

The invention claimed is:

1. A method for slicing a workpiece, comprising:

reusing a wire that was used to slice a previously sliced workpiece to slice the workpiece by:

pressing the workpiece against a wire row and slicing the workpiece while supplying a working fluid, the wire row being formed of the wire that is spirally wound between a plurality of wire guides and travels in an axial direction;

reducing a wire tension from a predetermined wire tension used when slicing the previously sliced workpiece to a value in the range of 87 to 95% of the predetermined wire tension, and at the time of slicing, slicing the workpiece with the reduced wire tension; and increasing a wire supply amount from a predetermined wire supply amount used when slicing the previously sliced workpiece to a value in the range of 125% or more of the predetermined wire supply amount, and at the time of slicing, slicing the workpiece with the increased wire amount.

2. The method for slicing the workpiece according to claim 1, wherein, at the time of slicing the workpiece, a workpiece feed rate is set to a value in the range of 83 to 91% of the workpiece feed rate that was used for the previously sliced workpiece.

* * * * *